US005791635A

United States Patent [19]

Hull et al.

[11] Patent Number: 5,791,635

[45] Date of Patent: Aug. 11, 1998

[54] FENCE POST WITH ANCHOR

[76] Inventors: Harold L. Hull, 401 Canyon Way #43, Sparks, Nev. 89434; Daniel Boyd, Rte. 1, Box 70, Schober Ln., Bishop, Calif. 93514

[21] Appl. No.: 782,124

[22] Filed: Jan. 13, 1997

[51] Int. Cl.[6] ..... E04H 17/14

[52] U.S. Cl. ..... 256/64; 256/35; 256/59; 52/156; 52/158; 248/547; 248/530; 248/156

[58] Field of Search ..... 256/64, 63, 59, 256/35, 30, 31; 52/156, 158, 159; 248/545, 547, 530, 156

[56] References Cited

U.S. PATENT DOCUMENTS

| | | | |
|---|---|---|---|
| 257,599 | 5/1882 | Lucas | 52/156 |
| 337,646 | 3/1886 | Allaben | 52/156 |
| 454,611 | 6/1891 | Crane | 52/156 |
| 542,976 | 7/1895 | Mesnard | 52/156 |
| 1,107,016 | 8/1914 | Bailey | 52/158 |
| 2,826,281 | 3/1958 | Johnson | 52/158 |
| 3,195,696 | 7/1965 | Stefan | 52/158 |
| 3,809,346 | 5/1974 | Jackson | 248/44 |
| 4,349,181 | 9/1982 | Asher et al. | 256/35 |
| 4,479,636 | 10/1984 | King | 256/35 |
| 4,530,190 | 7/1985 | Goodman | 52/165 |
| 4,663,902 | 5/1987 | Abbott, Jr. | 52/155 |
| 4,682,761 | 7/1987 | Hannaken | 256/36 |
| 4,706,921 | 11/1987 | Paulin | 52/158 X |
| 5,104,074 | 4/1992 | Malley | 52/156 X |
| 5,165,663 | 11/1992 | Wells | 256/19 |
| 5,240,230 | 8/1993 | Dougherty | 52/156 X |
| 5,395,184 | 3/1995 | Gagliano | 52/158 X |

*Primary Examiner*—Donald P. Walsh
*Assistant Examiner*—Emmanuel M. Marcelo

[57] ABSTRACT

Fence post construction including a main post which is installed in an upright vertical position within a post hole, with the post having at least one bracket fixedly attached thereto, with the bracket being located substantially just below the ground surface when the post is installed within the post hole and the bracket is of a shape and size to slidably receive a rod there through, thus the bracket and the rod in combination provide an anchor for securing the post within the ground.

1 Claim, 4 Drawing Sheets

FENCE POST WITH ANCHOR

FIELD OF THE INVENTION

The present invention relates to fence posts and means to anchor the post to the ground, but more particularly relates to a fence post having multiple brackets thereon for receiving a rod member there through, thus when the post is installed in the ground the brackets are substantially below ground level, and the brackets with the rods support the fence post in a secure manner, thus anchoring the fence post to the ground.

BACKGROUND OF THE INVENTION

In the past, numerous attempts have been made to provide suitable anchoring means for fence posts, as it is well known that once a post has been installed in the ground, it may be subject to upward or tilting forces for a number of reasons, such as due to changes in the weather which cause the ground to sometimes heave, or the ground may be subject to upward movement where the post is in a low lying area compared to other posts, or when the posts are connected by wires to form a fence, the wires may apply an upward force, etc. Also, the posts may even be stolen, vandalized or otherwise tampered with.

Therefore, problems associated with accidental fence post withdrawal have been addressed by numerous prior art patents, but there still exists a great need for improvement in this area, and the applicants believe the present invention is most advantageous and resolves these numerous problems in a manner heretofore not seen nor taught within the prior art.

It is to be noted that in most of the prior art, additional apparatus and multiple support structures are included, such as ground spades may be necessary, or multiple cross members are incorporated, etc.

Exemplary of such prior art include the following references; U.S. Pat. No. 4,663,902, wherein they teach the use of an adjustable strap which is wrapped around a cylindrical fence post, but this construction is not functional as the strap may easily be removed and the spade stolen, and the spade itself does not provide enough additional support as the post may still be easily removed.

U.S. Pat. Nos. 4,021,977 and 4,320,608 both teach the use of an anchor member which is first embedded into the ground with the post being inserted into the anchor member thereafter, and then a wedge completes the connection between the two.

Yet another attempt is represented in U.S. Pat. No. 5,428,927 wherein they teach an anchor device for a fence post having an extending leg with an opening near the base end thereof, with the anchor having an elongated anchor having a longitudinal slot therein to receive a portion of the post leg and a pin engages the anchor and passes through the leg opening transverse to the anchor and slot, with the anchor being pivotable about the pin. This reference is functional for its intended use but it could not be used as the present invention which provides an anchor means which is simple in construction and which provides an extremely strong anchor means, which heretofore has not been seen nor taught.

Still another attempt is represented in U.S. Pat. No. 4,682,761 wherein they provide a fence post stress and bracing system having a pair of fence posts which are interconnected by a cross bar with the cross bar having a central portion which supports two ground engaging members. This reference is again functional but is much to costly and unnecessarily complicated and being that the ground engaging members are not completely embedded within the ground, as they are within the present invention, the end result is not as secure as is the present invention. Also, this reference is very limited as two post must be used as only one post is not functional.

SUMMARY OF THE PRESENT INVENTION

It is therefore contended by the applicants that there remains a need for a fence post anchor device which is highly functional and provides a very strong anchor means, which addresses and overcomes the many inherent disadvantages known within the prior art.

It is therefore an object of the present invention to provide a fence post having unique construction including novel physical features heretofore not seen nor taught within the prior art.

It is another object of the present invention to provide a fence post having at least one pipe bracket attached onto the post at a location of engineering choice which when the post has been embedded within the ground, the bracket is positioned substantially just below the ground surface, with the bracket being of a shape and size to receive there through a rod, thus the rod and the bracket in combination secure the fence post to the ground in a unique manner.

It is yet another object of the present invention to provide a fence post having at least one or multiple brackets with each bracket being a section of a pipe.

It is another object of the present invention to provide a fence post which is anchored to the ground by at least one rod member, or multiple rod members, each of which may be a section of re-bar.

It is yet another object of the present invention is to provide the above noted rod members with stop means, such as a washer which is welded to the head of each rod.

Still another object of the present invention is to provide buttons or protrusions positioned on the post which may be used to secure barbed wire thereto, with the buttons being spaced at regular intervals so as to allow for proper height and spacing of the wire which reflects the requirements as specified for a particular fence.

It is another object of the present invention to provide a fence post which may be constructed from pre-existing parts with little or no modifications being necessary.

Also another object of the present invention is to provide a unique method for installing a fence post.

Yet another object of the present invention is to provide a fence post and method of installation wherein no back-filling is required.

Still further another object of the present invention is to provide a fence post which is simple and fast to install, rugged, versatile, and very stable.

Also another object of the present invention is to provide a fence post which is most economical to manufacture and easily marketable.

Other objects and advantages will become apparent when taken into consideration with the following detailed drawings and specification.

DETAILED DESCRIPTION OF THE DRAWINGS

Figure 1:
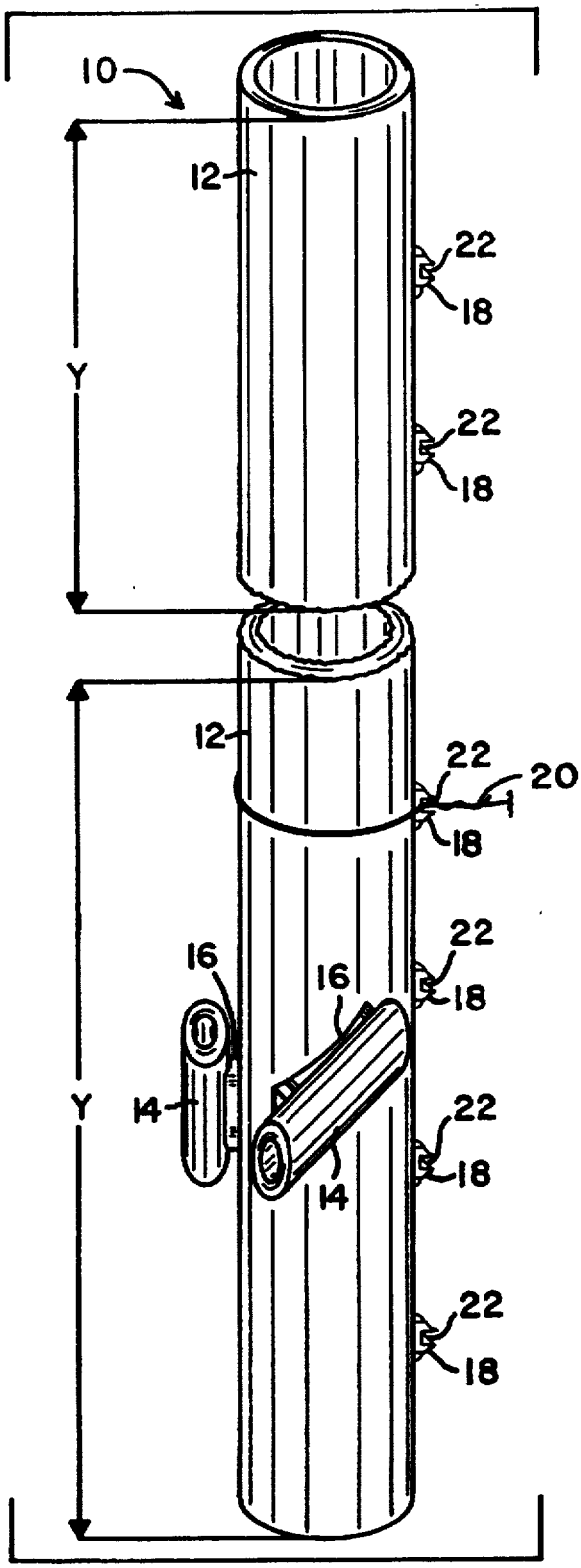
FIG. 1 is substantially a perspective view of the preferred embodiment for the present invention.

Referring now in detail to the drawings wherein like elements refer to like characters through out the various views. In FIG. 1, arrow (10) represents an overview of the present invention which is substantially a fence post having anchor means.

In FIG. 1, we show an elongated main fence post (12) having a vertical Y-axis, and the post (12) may be made from substantially any material of engineering choice, such as PVC or the like, or as we herein show and prefer it is made from metal and may have an outer diameter such as two and seven eighths, or any other diameter of engineering choice. Post (12) includes at least one bracket (14) which may be substantially any suitable bracket of choice but the applicants find that a simple piece of pipe is most efficient, with the pipe being substantially 1 inch in diameter and 2 inches long, respectively. Bracket (14) is fixedly attached to post (12) by any suitable means of choice, such as by welding (16) and is fixedly positioned substantially at a 45 degree angle to the Y-axis of post (12). It is to be noted that any suitable angle of choice may be used but the applicants have found that a 45 degree angle is most efficient. Further shown within FIG. 1, post (12) includes a second bracket (14) which is substantially positioned on post (12) at a 45 degree angle to the Y-axis of post (12) with each bracket being substantially 90 degrees apart and opposed to each other, respectively. Also, each bracket (14) is substantially set on post (12) at a position which allows each bracket (14) to be one inch below grade when driven into the ground, respectively, or the brackets (14) may be positioned at any other suitable depth of choice. It is to be noted that only two brackets (14) are shown, however multiple brackets may be attached on post (12) and each bracket (14) may be fixedly attached to post (12) at any location of choice and at any angle of choice.

Post (12) may further include multiple protrusions (18) substantially aligned along the Y-axis which are spaced apart substantially at regular intervals, and the protrusions (18) provide means to align and attach fence wire (20) to the post (12), such as an indent (22) may be provided or the like, which allows the wire (20) to be wrapped substantially around the post (12) and then secured within the indent (22).

Figure 2:
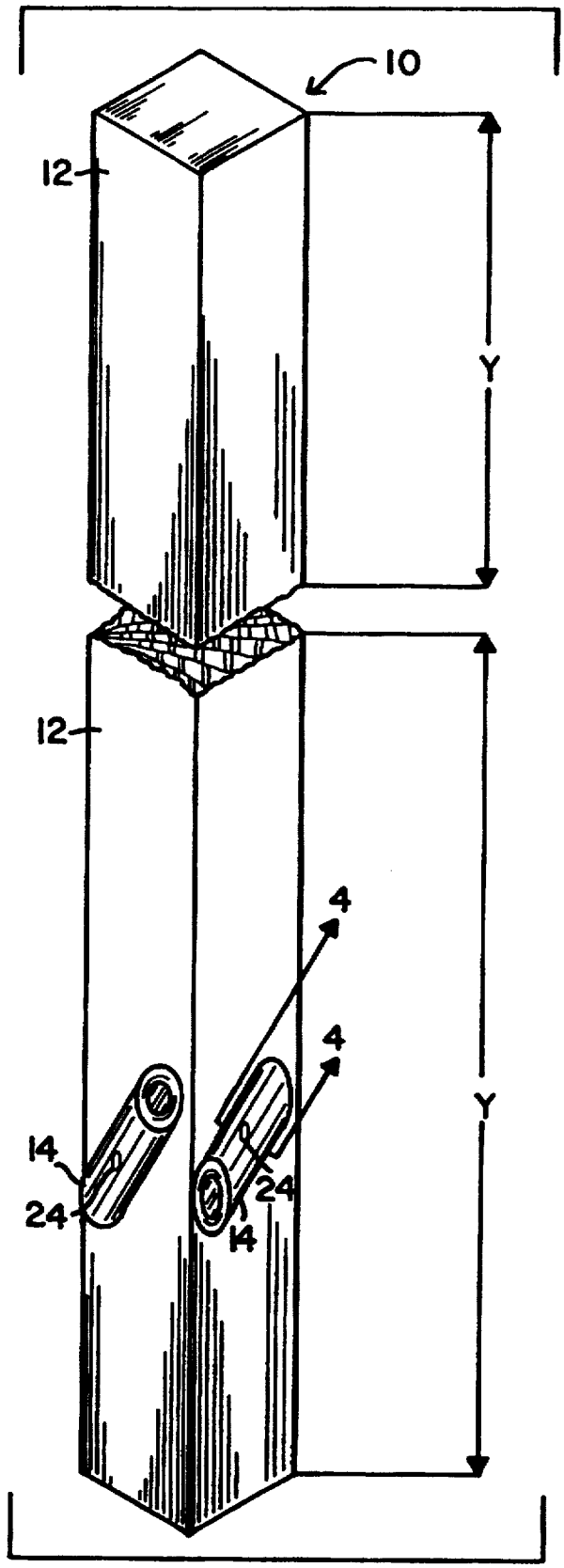
FIG. 2 is substantially a perspective view of a second embodiment for the present invention.
Figure 4:
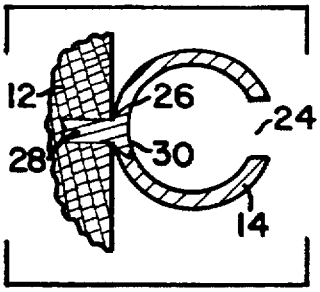
FIG. 4 is substantially sectional view taken at 4—4 of FIG. 2.

Referring now to FIGS. 2 & 4, wherein we show substantially a fence post (12) which is made from wood or the like, which again includes brackets (14) which are fixedly attached at a position of choice to post (12) by a different attachment means, such as bracket (14) may include a first and a second bore (24 & 26) through each side wall of bracket (14) with the first bore (24) being substantially of a size larger than the second bore (26), so as to allow a screw (26) to be inserted into and completely through the first bore (24) and then inserted into and through the second bore (26) and into the wood post (12), with the head (30) of screw (26) being substantially recessed within the second bore (26), thus each bore (24 & 26) in combination with screw (28) fixedly attaches bracket (14) to the wood post (12) in a secure manner.

Figure 3:
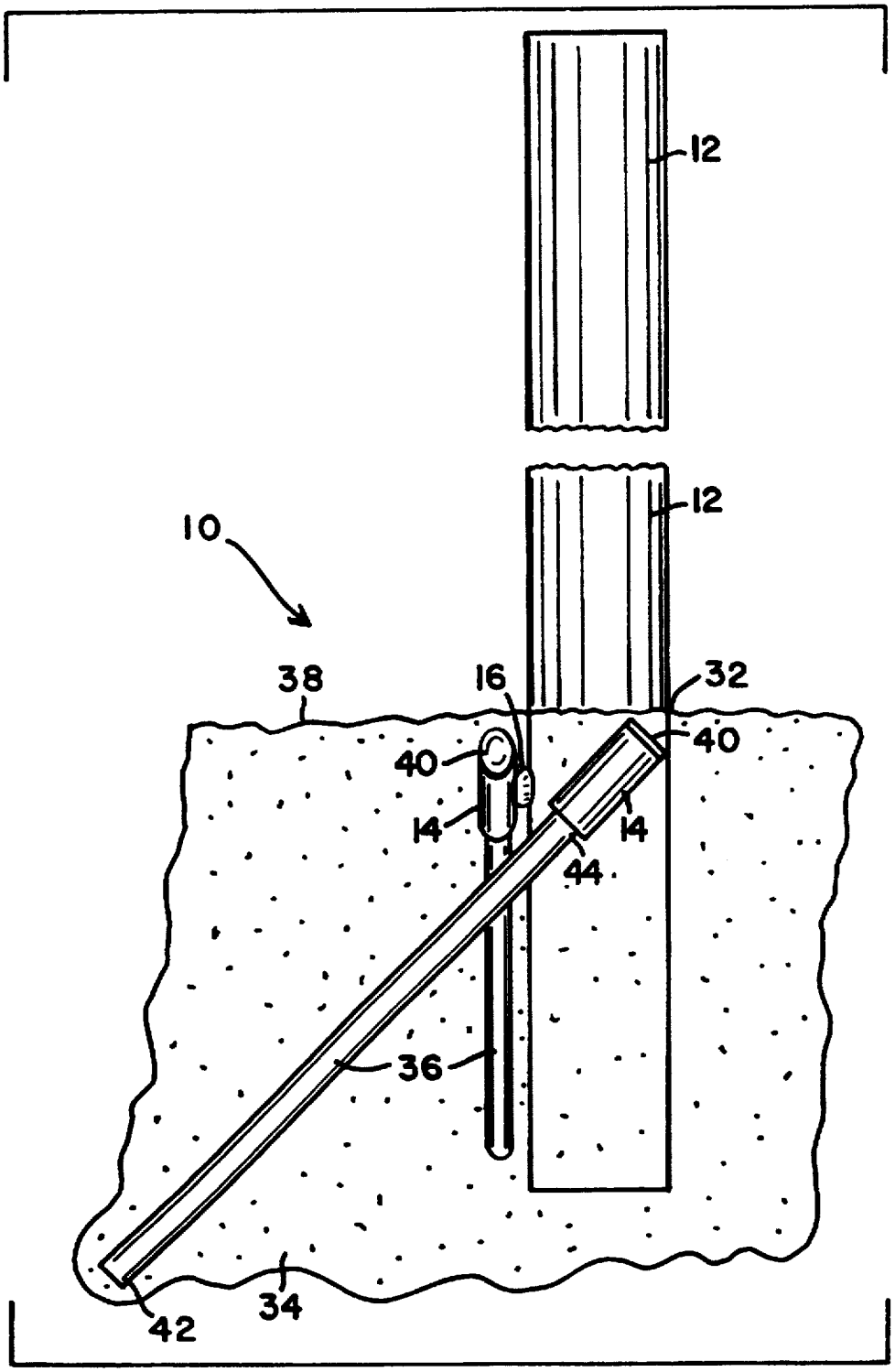
FIG. 3 is substantially a plan view for the present invention.

Referring now to FIG. 3, wherein we provide substantially a plan view for the present invention, with post (12) being substantially an elongated main post, (which may be either a metal post or a wooden post) having a vertical Y-axis and the post (12) is installed in an upright position extending above and within a post hole (32) and the hole extends vertically into the ground (34), with the post (12) having at least one bracket (14) fixedly attached thereto, with the bracket being of a shape and size to slidably receive a stabilizing rod (36) there through, such as a piece of re-bar or the like, with the bracket (14) being located substantially just below the ground surface (38) when the post (12) is installed within the post hole (32) and the rod (36) when installed within the bracket (14) is of a length to extend substantially into the ground (34), thus the rod (36) and bracket (14) in combination provide anchor means to secure post (12) to the ground (34).

In FIG. 3, we show two brackets (14) and two rods (36) but it is to be noted that multiple brackets and multiple rods may be used, depending on users choice.

Rod (36) further includes stop means which may be substantially any suitable stop means of choice, such as rod (36) may include a washer (40) which is fixedly attached by welding to one end of rod (36), with the washer (40) being substantially of a size larger than the inside circumference of bracket (14), thus the washer (40) not only provides stop means but also provides substantially a striking surface for a tool (not shown) used for driving the rod (36) into the ground (34).

Figure 5:
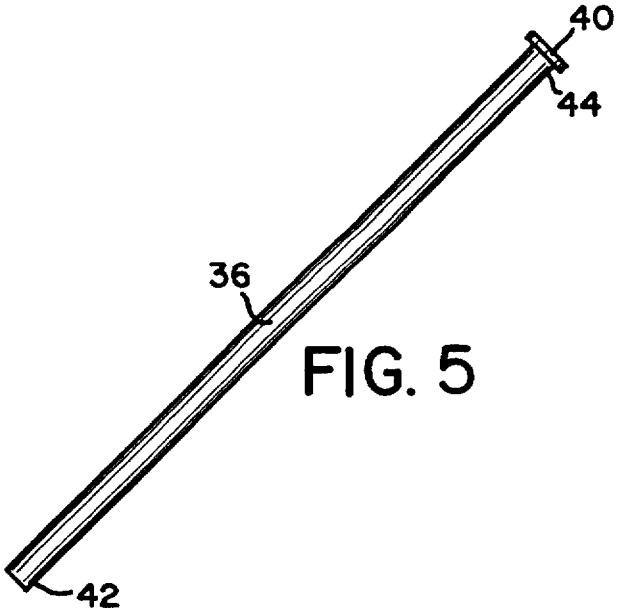
FIG. 5 is substantially a side view of a stabilizing rod.

It is to be noted that we further provide a method of installing and anchoring a fence post (12) within the ground (34), post (12) having at least one bracket (14) fixedly attached thereto, with bracket (14) being of a shape and size to slidably receive a stabilizing rod (36) there through, with rod (36) having a first and a second end (42 & 44), (see FIG. 5) with the second end (44) having stop means such as washer (40), with the method including the following steps of;

a. inserting post (12) vertically into a post hole (32);

b. grasping rod (36);

c. inserting the first end (42) of rod (36) into bracket (14) while supporting with one hand;

d. grasping a driving tool with the free hand;

e. hitting stop means (40) with the driving tool until stop means (40) engages bracket (14), whereby;

bracket (14) and rod (36) in combination provide anchor means for securing post (12) within ground (34).

We also provide a second method of installing and anchoring a fence post (12) within the ground (34), with post (12) having at least two brackets (14) fixedly attached thereto, with brackets (14) each being of a shape and size to slidably receive one of two stabilizing rods (36) there through, with rods (36) each having a first and a second end (42 & 44), with each second end (44) having stop means such as a washer (40) and the method including the following steps of;

a. inserting post (12) vertically into a post hole (32);

b. grasping one of the two rods (36);

c. inserting the first end (42) of one of the rods (36) into one of the brackets (14) while supporting with one hand;

d. grasping a driving tool with the free hand;

e. hitting stop means (40) with the driving tool until the stop means (40) engages bracket (14), f. grasping the second of the two rods;

g. repeating steps c–e;

whereby;

brackets (14) and rods (36) in combination provide anchor means for securing post (12) within ground (34).

It will now be seen that we have herein provided a fence post anchor device which is highly functional and provides a very strong anchor means, which addresses and overcomes the many inherent disadvantages known within the prior art.

It will also be seen th at we have herein provided a fence post having unique construction including novel physical features heretofore not seen nor taught within the prior art.

It will further be seen that we have herein provided a fence post having at least one pipe bracket attached onto the post at a location of engineering choice which when the post has been embedded within the ground, the bracket is positioned substantially just below the ground surface, with the bracket being of a shape and size to receive there through a rod, thus the rod and the bracket in combination secure the fence post to the ground in a unique manner.

We have also provided a fence post having at least one or multiple brackets with each bracket being a section of a pipe.

It will further be seen that we have herein provided a fence post which is anchored to the ground by at least one rod member, or multiple rod members, each of which may be a section of re-bar.

It will also be seen that we have herein provided the above noted rod members with stop means, such as a washer which is welded to the head of each rod.

It will also be seen that we have herein provided buttons or protrusions positioned on the post which may be used to secure barbed wire thereto, with the buttons being spaced at regular intervals so as to allow for proper height and spacing of the wire which reflects the requirements as specified for a particular fence.

Still further it will be seen that we have herein provided a fence post which may be constructed from pre-existing parts with little or no modifications being necessary.

Also it will be seen that we have herein provided a unique method for installing a fence post.

Still further it will be seen that we have herein provided a fence post and method of installation wherein no backfilling is required.

Also it will now be seen that we have herein provided a fence post which is simple and fast to install, rugged, versatile, and very stable.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

What we claim and wish to secure by Letters Patent is:

1. Fence post construction comprising: an elongated main post having a vertical Y-axis, said post is installed in an upright position extending above and within a post hole, said hole extends vertically into the ground, said post having at least one bracket fixedly attached thereto, said bracket being of a shape and size to slidably receive a stabilizing rod therethrough, said rod when installed within said bracket is of a length to extend substantially through said bracket into said ground, said bracket includes attachment means for fixedly attaching said bracket to said post, said attachment means including a first and a second bore through each side wall of said bracket, said first bore being substantially of a size larger than said second bore so as to allow a screw to be inserted into and completely through said first bore and then said screw is inserted into and through said second bore and into said post, and said screw having a head which is substantially recessed within said second bore, whereby;

said rod with said bracket in combination provide anchor means to secure said post to said ground, and each said bore in combination with said screw fixedly attaches said bracket to said post in a secure manner.

* * * * *